US006279685B1

(12) United States Patent
Kogan et al.

(10) Patent No.: US 6,279,685 B1
(45) Date of Patent: Aug. 28, 2001

(54) LIFTING APPARATUS

(75) Inventors: Eduard Kogan, Thornhill; William S. Ward, Unionville, both of (CA)

(73) Assignee: Hydra-Lift Industries Ltd., Markham (CA)

( * ) Notice: Subject to any disclaimer, the term of this patent is extended or adjusted under 35 U.S.C. 154(b) by 0 days.

(21) Appl. No.: 09/084,378

(22) Filed: May 28, 1998

(51) Int. Cl.[7] ..... B66F 7/08; B66F 7/28

(52) U.S. Cl. ..... 187/208; 187/203; 187/210; 187/213; 187/215; 187/274; 254/89 R; 254/89 H

(58) Field of Search ..... 254/89 R, 89 H; 187/203, 204, 207, 208, 210, 213, 214, 215, 272, 274; 52/730.6, 731.1, 731.7, 731.8, 731.9, 733.2

(56) References Cited

U.S. PATENT DOCUMENTS

| | | | | |
|---|---|---|---|---|
| 1,200,639 | * | 10/1916 | Moore et al. | 52/731.9 |
| 3,666,053 | * | 5/1972 | Tormey et al. | 187/208 |
| 3,683,471 | * | 8/1972 | Lemelson | 29/33 C |
| 3,687,234 | * | 8/1972 | Gendreau | 187/210 |
| 4,134,501 | * | 1/1979 | Tune | 187/208 |
| 4,328,951 | * | 5/1982 | Laupper | 187/208 |
| 4,531,614 | * | 7/1985 | Naegeli | 187/208 |
| 4,856,618 | * | 8/1989 | Isogai | 187/208 |
| 4,976,336 | * | 12/1990 | Curran | 187/213 X |
| 5,207,296 | * | 5/1993 | Beattie et al. | 187/208 |
| 5,207,297 | * | 5/1993 | Beattie et al. | 187/208 |
| 5,318,154 | * | 6/1994 | Hellman, Jr. et al. | 187/203 |
| 5,803,206 | * | 9/1998 | Halstead et al. | 187/208 |

FOREIGN PATENT DOCUMENTS

| | | | | |
|---|---|---|---|---|
| 566195 A1 | * | 10/1993 | (EP) | 187/208 |
| 66063 | * | 5/1956 | (FR) | 187/203 |

* cited by examiner

*Primary Examiner*—Eileen D. Lillis
*Assistant Examiner*—Thuy V. Tran
(74) *Attorney, Agent, or Firm*—Blake, Cassels & Graydon LLP

(57) ABSTRACT

A twin post lift has a master and slave cylinder system in which the maser and slave cylinders each drive a lifting carriage, and each of the lifting carriages is mounted within, and is restricted to longitudinal travel within, an upright member. In the event that there is a loss of pressure in the hydraulic system under load, it is important that the lift be prevented from descending unexpectedly, or uncontrolledly. The upright can be manufactured in the form of a roll formed channel section. The legs of the channel section are formed to define guides for guide followers mounted on the lifting carriage, thereby restraining the travel of the lifting carriages to travel in the vertical direction. The lifting carriage has a rack formed on its back face. The rack is nested within the upright member and is not visible in use. The back of the channel is formed with an outwardly protruding step to accommodate the rack. A safety stop, in the nature of a spring loaded safety dog, is mounted to the upright and extends through the wall of the protrusion to engage the rack.

2 Claims, 8 Drawing Sheets

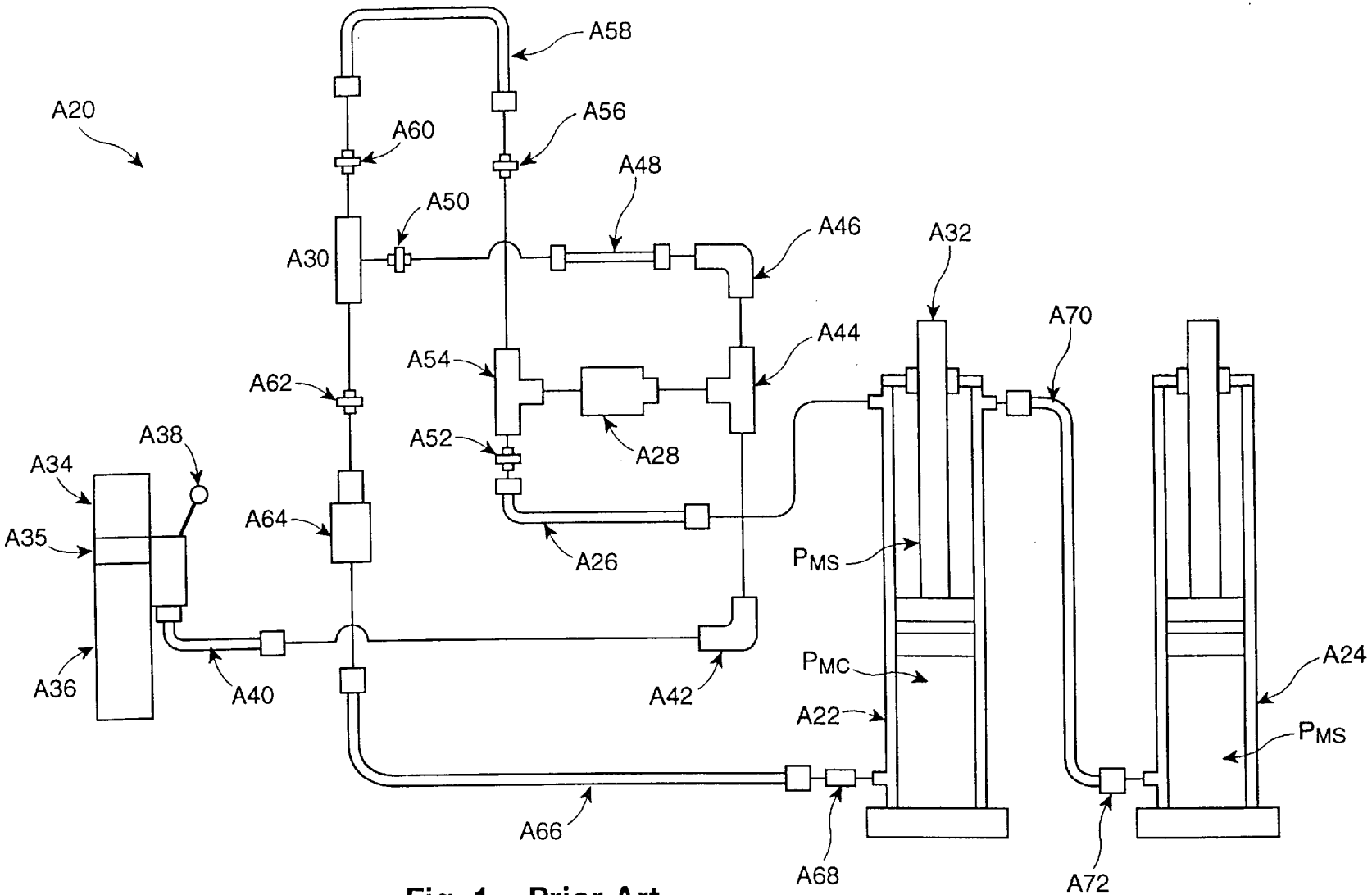
Fig. 1 – Prior Art

LIFTING APPARATUS

FIELD OF THE INVENTION

This invention relates to hydraulic lifting apparatus and systems for controlling the relative extension of master and slave cylinders in those systems.

BACKGROUND OF THE INVENTION

In many applications in the field of hydraulics a pair of hydraulic rams are used to cause displacement of a load. It is often important that the rams have a known, and relatively equal displacement, even if the load is placed more toward one ram than the other. A typical application in which this situation arises occurs in the use of twin post lifts for lifting vehicles in a repair shop. It is not desirable to lift one side of a vehicle significantly further than the other. A general solution to this problem is to employ a master and slave cylinder pair. In operation, an hydraulic pump pressurises the master cylinder. As the ram of the master cylinder moves, its displacement causes hydraulic oil to flow to the slave cylinder. The slave cylinder is matched to the master cylinder such that, ideally, displacement of the one is accompanied by equal displacement of the other.

It is possible, and undesirable, for the displacement of the master and slave rams to be unequal. This can occur for a number of reasons. One reason is that as the rams face a load, the hydraulic oil in the cylinders is pressurized, and will compress according to its bulk modulus of elasticity. As this occurs the master ram will tend to advance a small amount more than the slave. A second reason for unequal displacement is that there may be seepage past the seals of one or the other of the slave and master cylinders. This seepage may be very small, but over a number of repetitions a difference may build up. When a significant difference is noted it is necessary to reset the system to an equilibrium position.

A number of attempts have been made to discourage unequal lifting. In one instance a cable system has been used, with cables connected to each ram. The cables are paid out and drawn in at a common rate as the rams move. A cable system of this nature is an added expense. In another known system, shown in FIG. 1 as "Prior Art" and indicated generally as A20, the master A22 and slave A24 are connected to a dump line A26 which may be opened to supply line pressure by a by-pass valve A28, or by operation of a pilot operated check valve A30. Pilot operated check valve A30 opens when the pressure PMS in the master and slave line exceed the pressure PMC in the main cylinder beneath the master ram A32.

If the displacement of the slave and master rams in the system of FIG. 1 is unequal, the lift must be lowered to the ground for reset. With the load removed the bypass valve can be opened, and the two rams brought to their lowest, initial datum position.

The prior art embodiment indicated schematically in FIG. 1 also includes a large number of other elements. It would be advantageous to eliminate as many as those elements as possible in order to reduce the costs of the hydraulic system of a twin post lift. As a matter of pure enumeration the elements of the prior art embodiment are as follows: A34 is a motor; A35 is a hydraulic pump driven by the motor; A36 is a hydraulic reservoir or tank from which hydraulic pump A35 draws hydraulic fluid; A38 is a flow control which permits hydraulic fluid to be pumped from or dumped back into reservoir A36; A40 is a hydraulic tube assembly; A42 and A46 are both 90 degree elbows; A44 and A54 are both tees; A48 is a hydraulic tube assembly; A50, A52, A56, A60 and A62 are all adaptor fittings; A58, A66 and A70 are all hydraulic pipe assemblies; A64 is a pipe union; and A68 and A72 are hydraulic fuses.

Inasmuch as the market for twin post lifts is very competitive, and twin-post lifts of this nature are relatively inexpensive, the price of the pilot operated check valve is significant. It would be advantageous to eliminate both the cable system, the pilot operated check valve, and as much associated hardware, from the twin post lift as possible.

It is known to nest the master and slave hydraulic cylinders within the profile of the posts of a twin post lift, and to have lifting carriages driven by those nested cylinders. In the event that the hydraulic system should lose pressure while a load is still in a raised position, it is important that the lifting carriages be prevented from descending unexpectedly or uncontrolledly. To prevent this it is advantageous to have a safety stop system in which a rack, or similar device, is located on either the lifting carriage or on the upright, or post, and a corresponding pawl, gear tooth, catch, hook, dog, or other similar device is located on the other. If the load should start to slip the safety dog will engage the next available element of the rack and prevent further descent of the load.

It is advantageous to construct the major longitudinal element of the post from a roll formed channel having a back and a pair of extending legs. The legs can be formed to have a wide portion and a narrow portion, such that a lifting carriage carried within the channel is restricted to longitudinal motion along the channel. However, it is also advantageous to place the rack on the hidden spine of the lifting carriage, where it is nested inside the channel, and is not generally visible in use. Inasmuch as the channel extends outwardly from the back of the lifting carriage space, and space within the depth of the channel is restricted, it is advantageous to provide a deeper rebate to accommodate the rack while still maintaining the guide geometry of the legs of the channel. This can be achieved by locally forming the back of the channel outwardly to give a larger space for the rack. Further, by forming the back outwardly the desired result can be achieved while retaining the monolithic roll formed part. This keeps the manufacturing cost of the post down, while actually deepening the channel and increasing its resistance to bending. Finally, it is advantageous to reinforce the edges of the post closest to the lifting arms of the carriage. One way to do this is to fold the roll formed sheet over to give a double thickness locally.

SUMMARY OF THE INVENTION

In one aspect of the invention, there is a twin post lift comprising a master cylinder and a co-operating slave cylinder each having a ram connected to drive a lifting carriage of said lift. The slave cylinder has a slave pressure chamber and a piston exposed to pressure therein for driving the ram of the slave cylinder. The master cylinder has a master cylinder piston mounted therein to define a main pressure chamber to one side thereof and a secondary pressure chamber to the other side thereof. The secondary pressure chamber and the slave pressure chamber are in fluid communication. The main pressure chamber is in controlled fluid communication with a source of pressurized fluid. A controllable flow shunt has one port directly exposed to the pressure prevailing in the main pressure chamber, and a second port exposed to the pressure prevailing in the secondary pressure chamber. The shunt is operable to bleed pressure between the main and secondary pressure chambers.

In an additional feature of that aspect of the invention, the twin post lift further comprises a fluid supply line connected to said main pressure chamber, through which the main pressure chamber communicates with the source of pressurized fluid. A flow control valve is located in the fluid supply line between the main pressure chamber and the source of pressurized fluid for controlling flow there between. The first port is connected with the fluid supply line between the flow control valve and the main pressurized chamber.

In an alternative additional feature of that aspect of the invention, the twin post lift further comprises a master and slave communication line connected between the secondary pressure chamber and the slave pressure chamber, and the second port is connected to communicate with the master and slave communication line.

In another alternative additional feature of that aspect of the invention, the shunt has a segregated tapping into at least one of (a) the main pressure chamber; and (b) the secondary pressure chamber.

In a further alternative feature of that aspect of the invention, the bleeding of pressure across said shunt is controlled by a needle valve.

In a still further alternative feature of that aspect of the invention, the shunt is formed within a manifold, having a first passage for placement in a line between the source of pressurized fluid and said main pressure chamber, a second passage for placement in a line between said secondary pressure chamber and said slave pressure chamber, and the first port gives onto the first passage and the second port gives onto the second passage.

In yet another alternative additional feature of that aspect of the invention, the lift further comprises a control for controlling pressure in the main pressure chamber. The main pressure chamber is subject to pressures varying from a dump pressure to an operating pressure, and the shunt is operable at the dump pressure and at the maximum pressure.

In an additional feature of the additional feature, the shunt is operable over the entire range of pressures to which the main pressure chamber is subject.

In a still further additional feature of that aspect of the invention, the rams are each moveable between a lowered position and a raised position and the shunt is operable in the raised position.

In yet a still further additional feature of that aspect of the invention, the shunt is operable at any static position of the lift from the lowered position to a maximum height raised position.

In a still further additional feature of that aspect of the invention, the lift can be in a loaded condition or an un-loaded condition and the shunt is operable in the loaded condition and in the unloaded condition.

In a further aspect of the invention, there is an upright for use in co-operation with a mating longitudinally moveable lifting carriage of a lifting apparatus, the carriage having a longitudinal rack. The upright comprises a channel for receiving a portion of the lifting carriage therewithin, the channel having a longitudinal opening through which another portion of the lifting carriage can protrude. The carriage also comprises at least one guide for restricting the lifting carriage to longitudinal motion relative to the upright and a longitudinal rebate for accommodating said rack. There is a mounting site for a safety step located to permit a safety stop mounted thereto to engage the rack.

In an additional feature of that aspect of the invention, the rebate is formed to give a clearance gap between itself and the rack when the lifting carriage is moveably engaged within said channel.

In a further additional feature of the invention, the upright further comprises an aperture to permit a safety stop mounted externally to the upright to extend inwardly therethrough to engage the rack.

In a still further additional feature of that aspect of the invention, the channel has a back and a pair of opposed legs extending therefrom. The legs define the longitudinal opening therebetween, and the rebate is formed in the back.

In a yet further additional feature of that aspect of the invention, the rebate is formed to give a clearance gap between said rebate and the rack when the lifting carriage is moveably engaged within said channel.

In an alternative additional feature of the invention, one of the legs is chosen from the set of legs consisting of: (a) legs having the guide mounted thereto; and (b) legs having the guide integrally formed therein.

In a further alternative additional embodiment of the invention, each of the legs has a root portion adjoining the back and a toe distant from the back. The channel has a profile having a maximum breadth between the legs at a location between the root and the toes. The toes are separated by the longitudinal opening. The breadth is greater than the width of the opening.

In a further additional feature of that aspect of the invention, the channel is a roll formed channel having a back and a pair of opposed, symmetrical legs extending therefrom. Each of said legs has a proximal portion adjoining the back, parallel to the proximal portion of the outer leg; a medial step extending inwardly from the proximal portion at a right angle thereto, and a distal portion adjoining the medial step and extending away from the back parallel to the distal portion of the other leg. The distal portion terminates in a folded toe. The rebate is a roll-formed step formed in the back to give a clearance gap between the rebate and the rack when the lifting carriage is moveably engaged within the channel.

In a further aspect of the invention, there is a combination of an upright and a mating longitudinally moveable lifting carriage, both for use in a lifting apparatus. The upright has a channel for receiving a mating portion of the lifting carriage therewithin. The channel has a longitudinal opening through which another portion of the lifting carriage can protrude. The upright has at least one guide for restricting the lifting carriage to longitudinal motion relative to the upright; a longitudinal rebate for accommodating a rack of the lifting carriage; and a mounting site for a safety stop, located to permit a safety stop mounted thereto to engage the rack of the lifting carriage. The lifting carriage has a first portion for longitudinally moveable engagement within the channel, and another portion attached to the first portion and extending through the opening for connection to a load carrying arm. A rack is on the first portion in a position to be accommodated by the rebate and to be engaged by a safety stop mounted to the upright. The lifting carriage has at least one guide follower for engaging the at least one guide.

In an additional feature of that aspect of the invention, the rebate is formed to give a clearance gap between the rebate and the rack when the lifting carriage is engaged within the channel.

In a further additional feature of that aspect of the invention, the first portion has a longitudinally aligned spine. The rack is formed from a channel having toes mounted to the spine and a back having openings let therethrough for engagement by the safety stop.

In a further additional feature of that aspect of the invention, channel has a back and a pair of opposed legs extending therefrom. At least one of the legs has a proximal portion adjoining the back. An inward step adjoins the proximal portion and extends inwardly therefrom. A distal portion adjoins the step and extends away from the back to terminate in a distal toe. The longitudinal opening is defined between the distal toe and the other leg. The back has a pair of shoulders each adjoining one of the legs. The rebate is formed in the back intermediate the shoulders. One of the shoulders, the proximal portion and the step co-operate to define the guide. The guide follower protrudes to nest within the guide and has a bearing for engaging the guide.

BRIEF DESCRIPTION OF THE DRAWINGS

For a better understanding of the present invention and to show more clearly how it may be carried into effect, reference is made by way of example to the accompanying drawings, which show an apparatus according to the preferred embodiment of the present invention and in which:

FIG. 1, as noted above, is a schematic of a prior art twin post lift system.

DETAILED DESCRIPTION OF THE PREFERRED EMBODIMENT

Figure 2A:
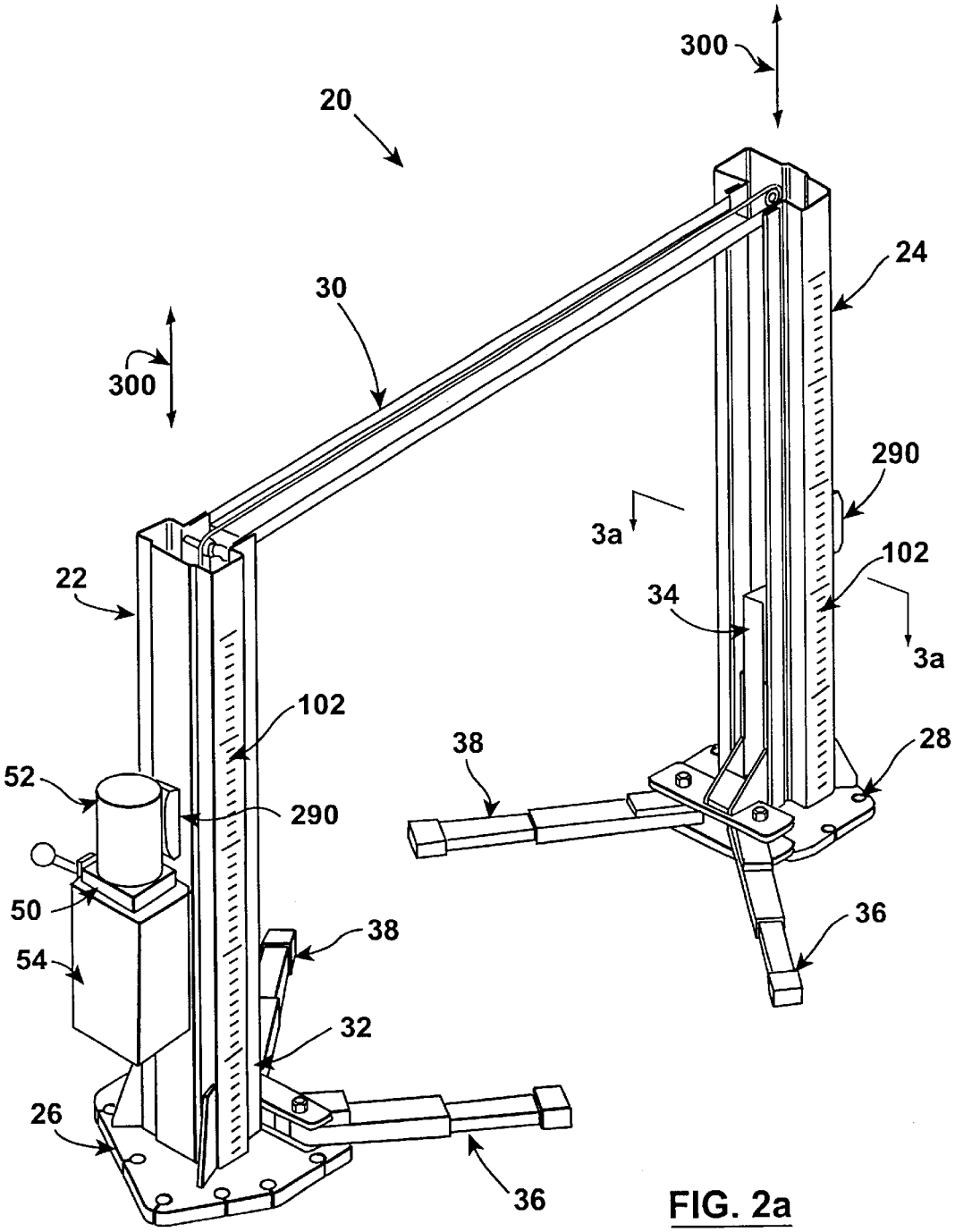
FIG. 2*a* is a three-quarter general arrangement view of a simplified embodiment of a twin post lift according to the present invention.

The description of the invention is best understood by commencing with reference to FIG. 2*a*, in which some proportions have been exaggerated for the purposes of conceptual illustration.

Referring to FIG. 2*a*, an example of a twin-post lift embodying the present invention is indicated generally as 20. It includes a lifting frame having a first upright 22 and a second upright 24. Uprights 22 and 24 each have a base, 26, or 28, upon which they stand vertically. They are spaced apart a distance chosen for the width of vehicles intended to be raised by lift 20, plus a clearance distance. Uprights 22 and 24 are joined at their upper ends by a transom member 30 which maintains their relative spacing and position. Lifting carriages 32 and 34 ride up and down uprights 22 and 24 respectively. Carriages 32 and 34 have cantilevered lifting arms 36 and 38 extending generally toward each other upon which a load, such as a vehicle to be repaired (not shown) can be lifted.

Figure 3A:
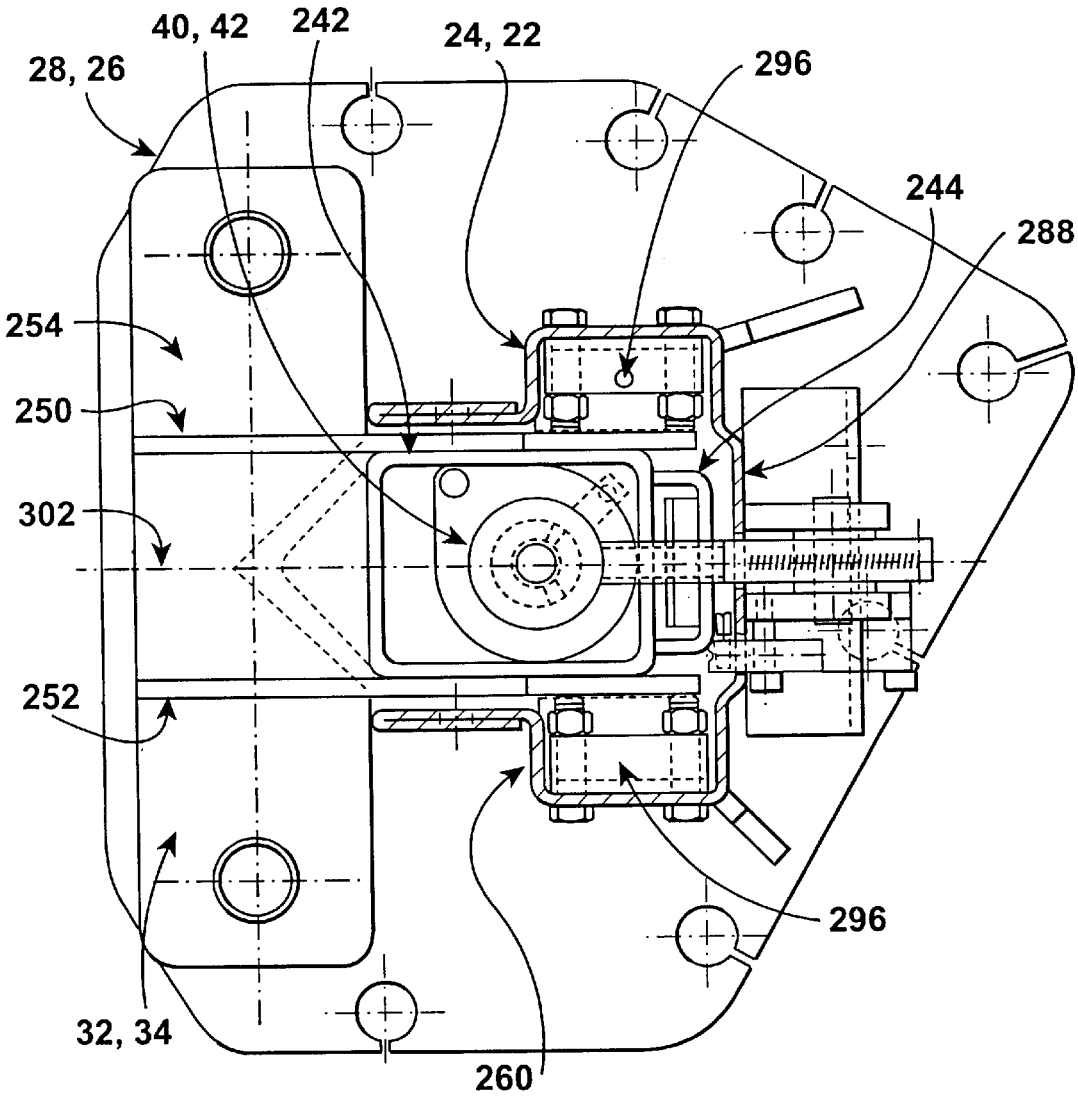
FIG. 3*a* is a cross section of a post of the twin post lift of FIG. 2*a* taken on section '3*a*—3*a*'.

FIG. 3*a* shows a cross-section of upright 24. It will be understood that upright 22 is the same, but of opposite hand. In the description that follows both left and right hand item numbers are given, although only one hand is illustrated. As shown in FIG. 3*a* carriages 32 and 34 are driven upon uprights 22 and 24 by a pair of hydraulic cylinders nested inside one or the other of uprights 22 and 24. The first of these is a master cylinder 40, the second is a slave cylinder 42. Both are shown schematically in FIG. 4. They are joined by a master and slave communication line 44 which runs along transom 30 and links an upper chamber 46 of master cylinder 40 and a lower chamber 48 of slave cylinder 42. An hydraulic pump 50, driven by an electric motor 52 or other suitable drive, draws hydraulic fluid from a source in the nature of a reservoir 54 and pumps it through a hydraulic source line 56 into a lower chamber 58 of master cylinder 40.

As pump 50 operates, pressure builds in lower chamber 58. The difference in force between the pressure in lower chamber 58 acting on the lower face 60 of piston 62, less the pressure in upper chamber 46 acting on the annular upper face 64 of piston 62, tends to drive master ram 66 upwards, thereby forcing carriage 32 to rise. As ram 66 is displaced upward, it must also displace hydraulic fluid from upper chamber 46, through communication line 44 into slave cylinder 42. This in turn causes slave cylinder ram 68 to be displaced upward.

Figure 4:
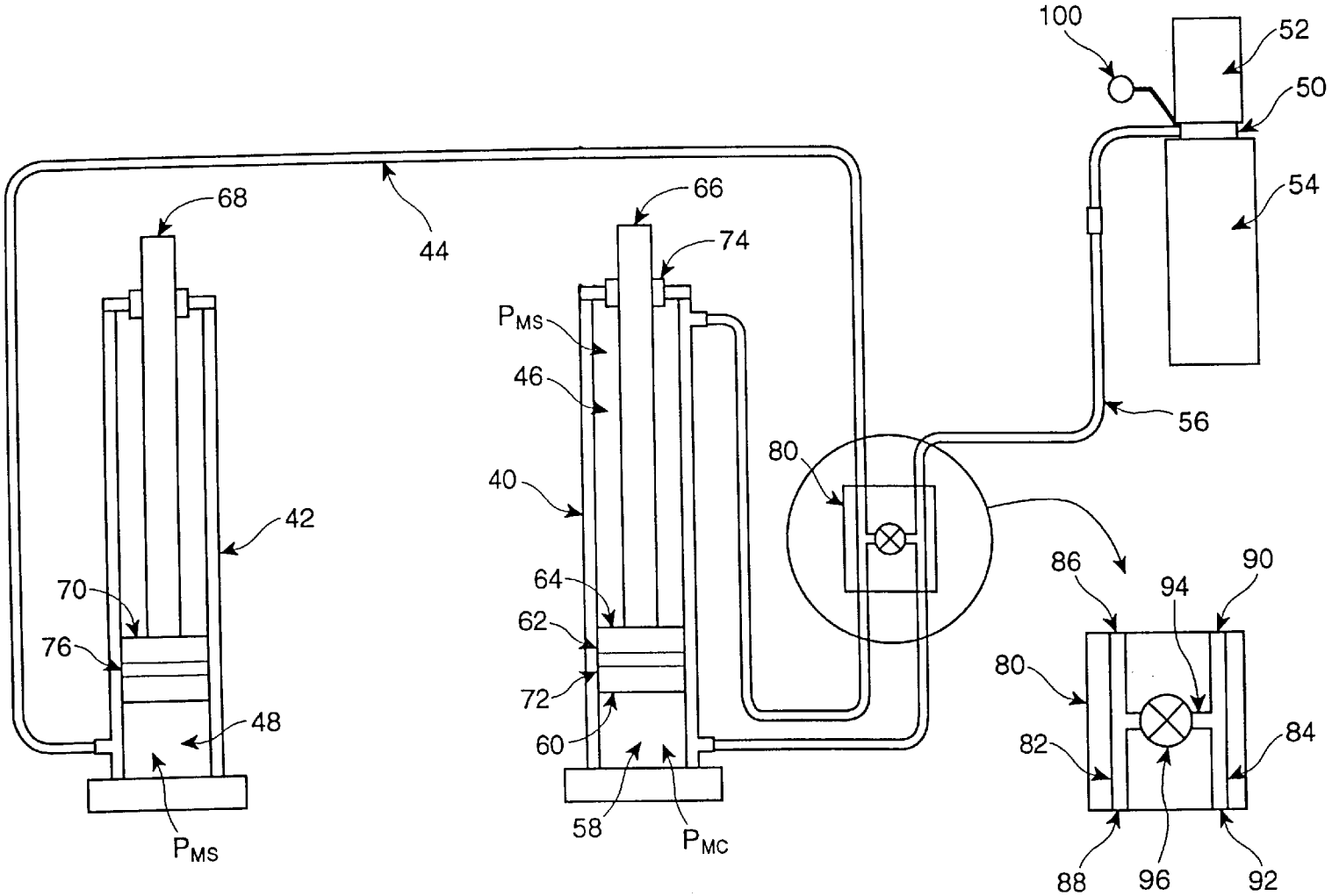
FIG. 4 is a schematic of a hydraulic system for the twin post lift of FIG. 2*a*.
Figure 5C:
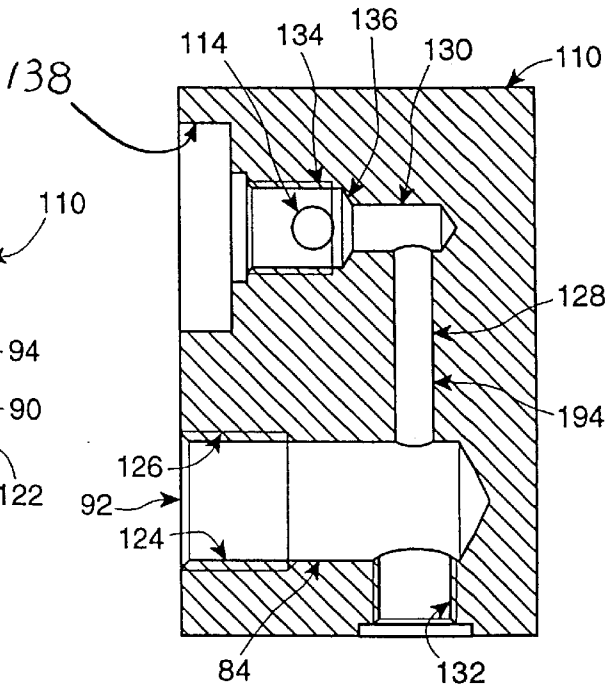
FIG. 5*c* is a sectional view taken on section '5*c*—5*c*' of FIG. 5*a*.
Figure 5D:
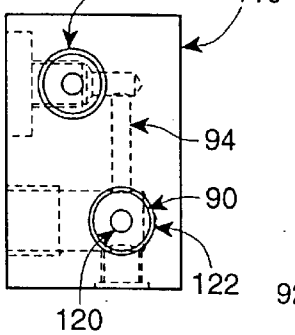
FIG. 5*d* is an end view taken on arrow '5*d*' of FIG. 5*a*.
Figure 5A:
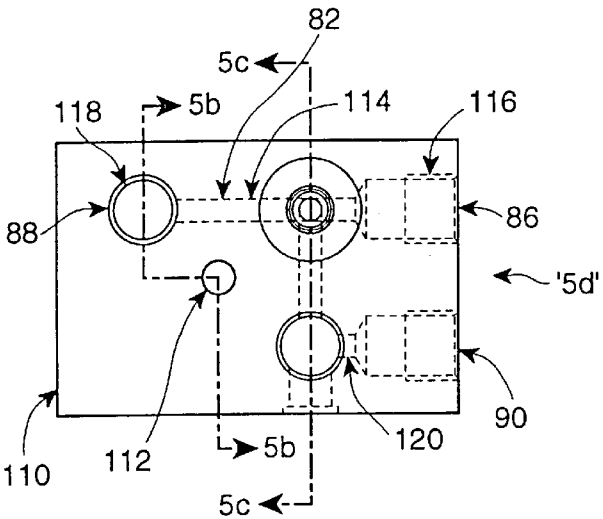
FIG. 5*a* is a profile view of a manifold block of the hydraulic system of FIG. 4.
Figure 5B:
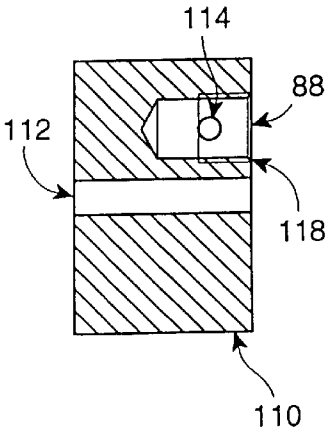
FIG. 5*b* is a sectional view taken on the stepped section '5*b*—5*b*' of FIG. 5*a*.

In the system of FIGS. 2*a* and 4 the area of piston 70 of slave cylinder 42 is, within manufacturing tolerance, equal to the annular area of upper face 64 of piston 62. Thus the vertical displacement of ram 68 is intended to match the vertical displacement of ram 66. The pressure acting on upper face 64 is determined by the portion of the load carried by slave cylinder 42. In an ideal system, there is no seepage past any of the seals in the system. In actual use piston 62 has a circumferential seal 72, master cylinder ram 66 has a seal 74 and slave cylinder ram piston seal 76, each of which is exposed to differential hydraulic pressure. Over time a small amount of seepage will occur at one or more of these seals.

Master cylinder ram 66 will always move before slave cylinder ram 68, due to the friction in the seals, and due to the compressibility of the hydraulic oil. As such, ram 66 will tend to begin to move slightly ahead of, and will lead, ram 68 as the load is lifted. If the lifting ceases at a certain height rams 66 and 68 will stop travelling, in the same relationship.

After a time there may be a noticeable discrepancy between the height of carriages 32 and 34, such that adjustment may be either desired, or required. Master and slave communicating line 44 and hydraulic source line 56 are bridged by a manifold 80. Manifold 80 has a pair of passages 82 and 84, each having first and second ports 86 and 88, 90 and 92, respectively. Ports 86 and 88 are tapped into master and slave communicating line 44, and ports 90 and 92 are tapped into hydraulic source line 56. Bores 82 and 84 communicate through a shunt 94 that is controlled by a threaded needle valve 96.

When needle valve 96 is closed, there is no flow between master and slave line 44 and hydraulic source line 56. However, as soon as needle valve 96 is opened the pressure in master and slave line 44 will change to approach the pressure in hydraulic source line 56. As the pressure differential across main cylinder piston 62 drops, the balance of forces on main cylinder master ram 66 also changes, causing carriage 32 to want to descend. Assuming that flow control valve 100 in hydraulic source line 56 is closed, master rain 66 can only descend a small distance before the pressure in slave cylinder 42 rises. In the limit, the pressure in slave cylinder 42 cannot rise beyond the point at which the total force on the face of piston 70 equals the entire load. With flow control valve 100 closed, and needle valve 96 open, the mass of hydraulic fluid contained in the sum of the volumes of slave cylinder lower chamber 48, master cylinder upper chamber 46, and master cylinder lower chamber 58 is constant, and will have uniform pressure. Therefore it can only expand or contract under load according to its bulk modulus of compression. Consequently the total possible excursion of master ram 66 is small, and the total flow past needle valve 96 is also small.

Although an operator would generally wish to reset the system at no load, with lifting arms 32, 34, 36 and 38 at their lowest positions, the system can be adjusted at its highest position, either under pressure or with the pressure in master cylinder lower chamber 58 bled to ambient before opening needle valve 96, or at some intermediate pressure. Further, needle valve 96 is sufficiently sensitive that an operator can bleed only a portion of the pressure difference away from between line 44 and line 56, stopping ram 66 at a desired position. For the purposes of aiding an operator in this endeavour, uprights 22 and 24 can be, optionally, provided with gradations 102 by which an operator may judge carriage height.

The extent by which this simple system is an improvement over the prior art has been noted above, qualitatively, in the ability to adjust the system whether under pressure or not. It is further emphasized by a part by part comparison with FIG. 1. In the preferred embodiment, manifold 80 is a machined block, with a very simple threaded needle valve having a knurled knob. Even greater sensitivity could be produced with a somewhat extended lever arm. It permits the removal of the relatively expensive pilot operated check valve, A30, by-pass valve A28, two tees, A42 and A46, three hydraulic tube assemblies A48, A58 and A26, pipe union A64, six male to male adapters A50, A52, A56, A60 and A62, and a pair of pipe elbows A42. The reduction or elimination of all of these parts and the replacement by a smaller number of simpler parts reduces the cost of assembly.

In a more detailed description of manifold 80, and with reference to the views of FIGS. 5*a*, 5*b*, 5*c*, and 5*d*, a machined block 110 has a through bore 112 by which it can admit fastening hardware for fastening manifold 80 to upright 22. First passage 82 is formed by drilling a blind passage 114 into block 110. Port 86 is located at a threaded, countersunk end 116 of passage 114. A threaded, blind cross bore 118 intersects the inner end of passage 114, creating an L-shaped continuous passage, being passage 82. It ends at port 88, as shown.

Second passage 84 is similarly formed by drilling a passage 120, parallel to, and shorter than, passage 114, with a similarly countersunk end 122 forming port 90. Another passage 124 is drilled to intersect perpendicularly the end of passage 120, to cross it and to extend into block 110 to a depth corresponding to, but not intersecting, passage 114. Port 92 is located at the countersunk end 126 of passage 124.

Shunt 94 is formed by drilling a blind cross-bore 128 that is mutually perpendicular to passages 124 and 120, and which intersects the inner end of passage 124. Blind cross-bore 128 extends through the majority of the depth of block 110 to meet the inner end of the second portion of shunt 94, being an intersecting bore 130. At its outer end blind cross-bore 128 has a countersunk and threaded end 132 which receives, and is blocked by, a blank plug (not shown). Intersecting bore 130 is doubly countersunk. It has a first, countersunk portion 134 terminating in a chamfered shoulder 136, and a second, threaded countersunk portion 138 for accommodating the knob of needle valve 96. As the needle valve advances into the socket formed by countersunk portion 134, it prevents communication between passages 82 and 84. When it is withdrawn, even very slightly, communication will be restored.

Figure 6:
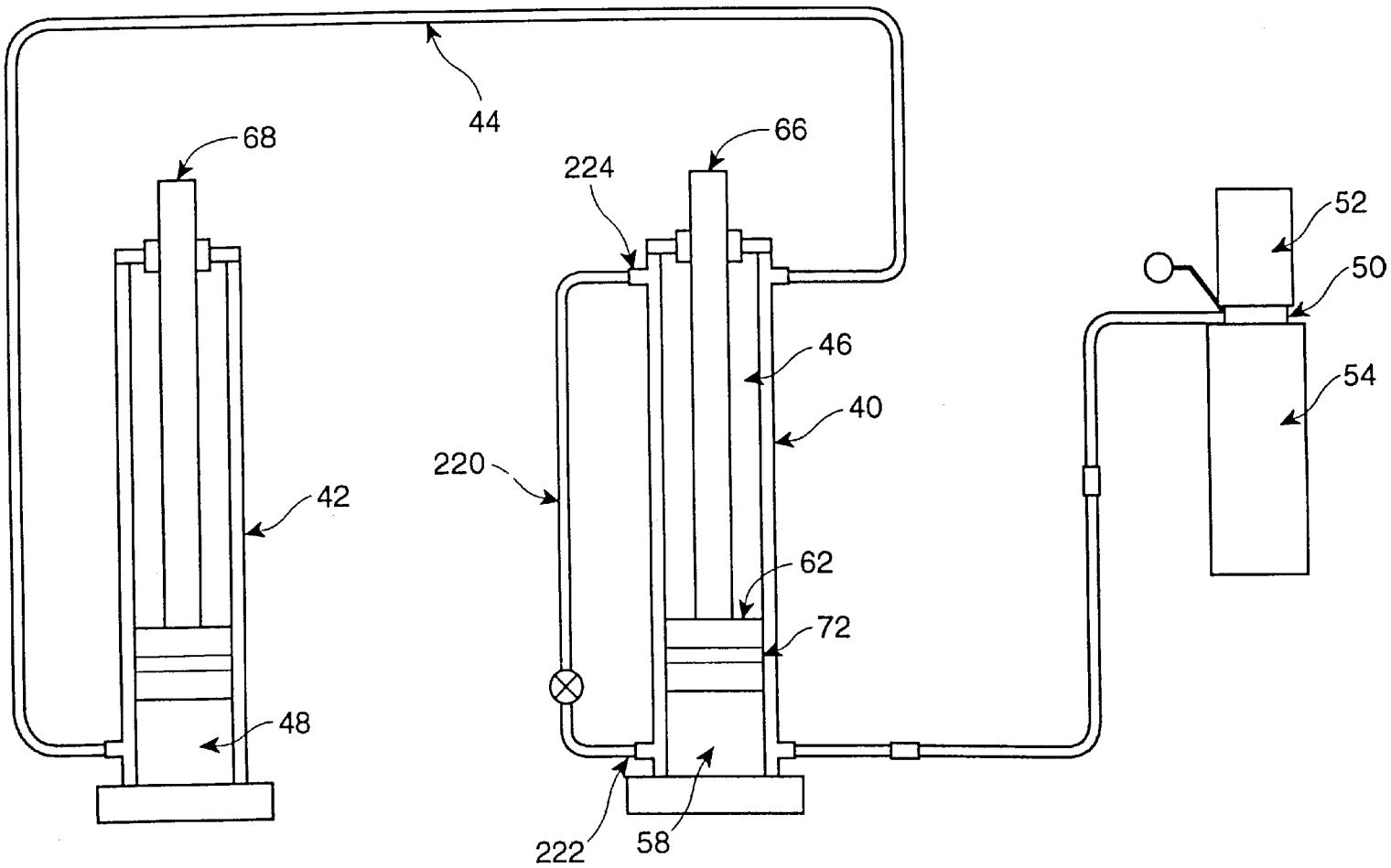
FIG. 6 shows an alternative embodiment of hydraulic system to that shown in FIG. 4.

Alternative embodiments are possible. For example, as shown in FIG. 6, a straight by-pass line 220 can be tapped into master cylinder 40, with one port 222 below the lowest travel of piston 62, and another port 224 above the highest travel of piston 62, such that ports 222 and 224 will always straddle seal 72. A needle valve 226 is located to control flow in line 220. Operation of needle valve 226 at any static position of rams 66 and 68 will cause the pressure difference across seal 72 to be bled away.

Figure 2B:
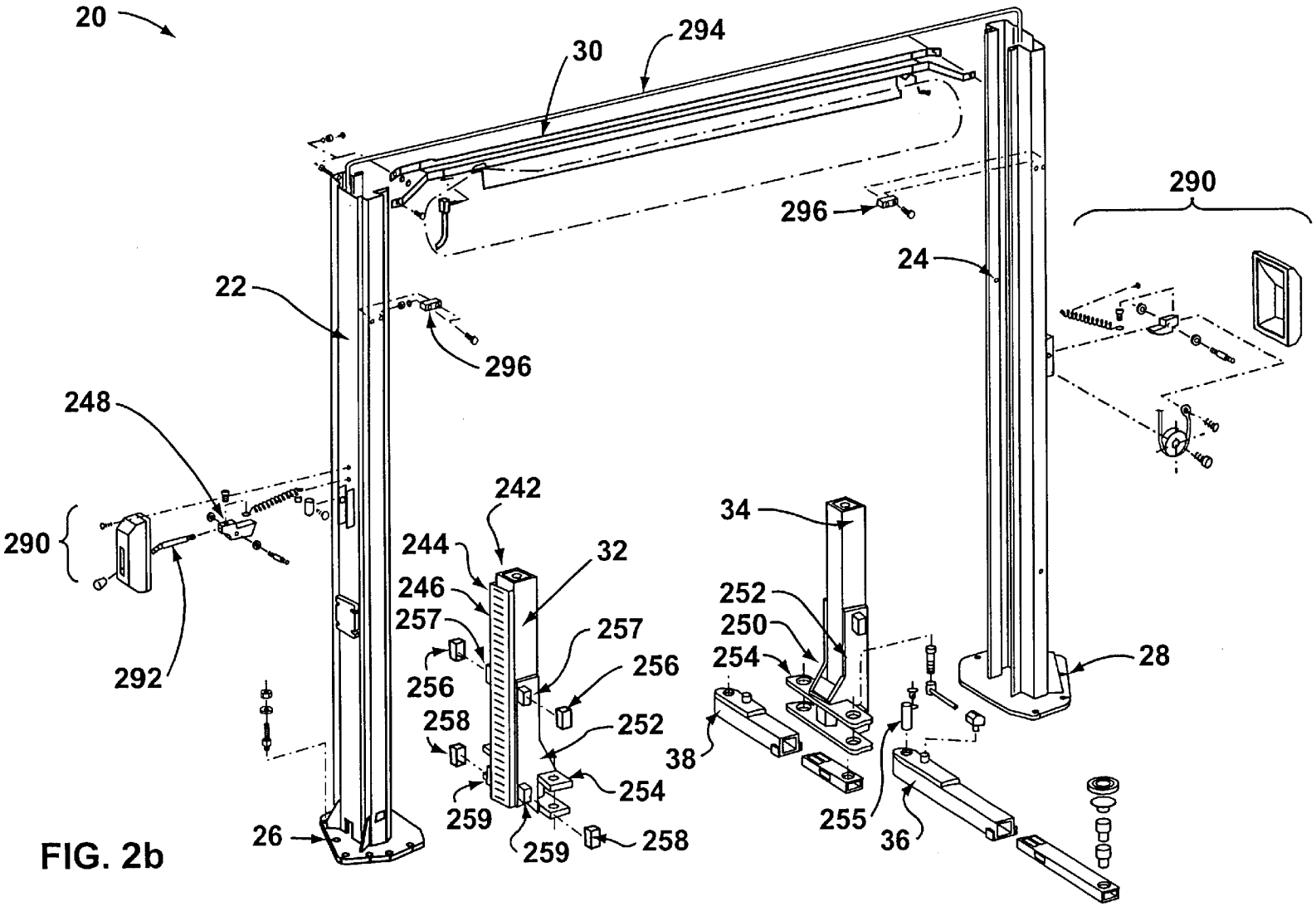
FIG. 2*b* is an exploded detailed view of the twin post lift of FIG. 2*a*.
Figure 3B:
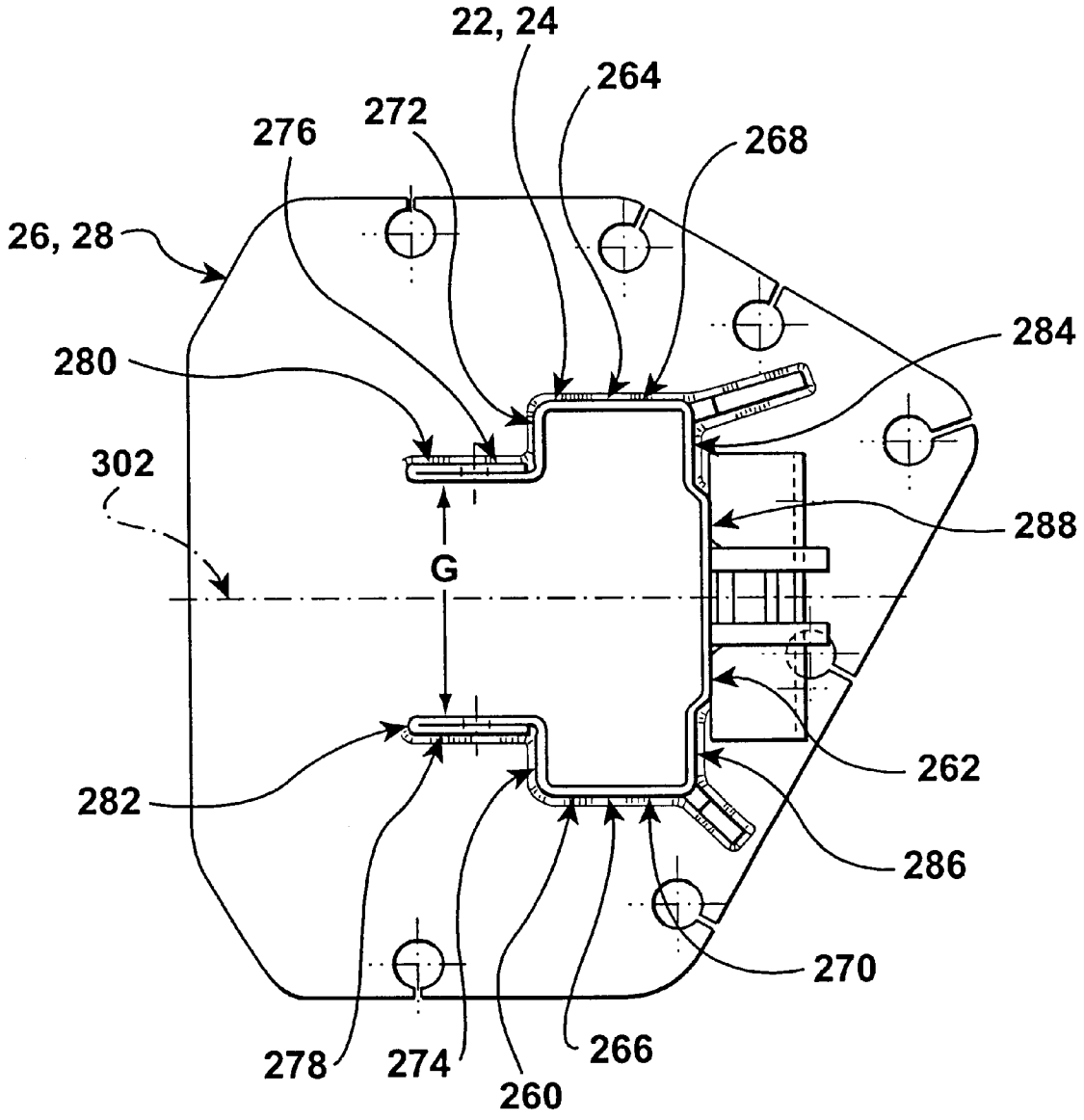
FIG. 3*b* is a view similar to FIG. 3*a*, showing the profile of an upright member.

A more detailed description of the structure of twin post lift 20 will now be provided with the aid of FIGS. 2*b*, 3*a*, and 3*b*. Lifting carriage 34, which is typical, has a first portion in the nature of a seamless steel tube 242 mounted to be driven by ram 66 of master cylinder 40 within the channel shaped profile of upright 22. Along its spine, tube 242 has a dorsal channel, 244, welded with its toes inward toward the spine. Channel 244 has its back facing outward from tube 242 and has openings in the nature of notches 246 (shown in FIG. 2*b*) on carriage 32. When installed within upright 24 or 22, notches 246 form a rack placed to trip the pawl of a spring loaded safety stop in the nature of a safety dog 248, as carriage 34 or 32 rises. In the event that ram 66 or 68 ceases to support carriage 32 or 34 then dog 248 win catch on one of notches 246 and prevent carriage 32 or 34 from falling further. A rack could also be formed with ridges, gear teeth, ribs, or other formations that do not necessarily form an opening in channel 244, but do provide intermittent asperities upon which a stop in the nature of a tooth, pawl, or dog can catch. In the embodiment illustrated, the operator can cause dogs 248 to be retracted to permit carriages 32 and 34 to descend under control when a load is being lowered.

Tube 242 is reinforced toward its lower end by another portion of lifting carriage 32 (or 34 as the case may be) in the nature of a pair of left and right hand notched gusset plates 250 and 252, the toe of each gusset extending outwardly to engage, and be doubly fillet welded to, the top of a lifting arm yoke assembly 254 which also fits into the notch of plates 250 and 252. Lifting arms 36 and 38 are held in their respective places by pivot pins 255 fit through eyes in yoke assembly 252. High molecule weight polymer upper and lower guiding bearings 256 and 258 are mounted on ears 257 and 259 in alignment on plates 250 and 252 toward the rearward, or inner region thereof, for riding within the profile of upright 24.

Upright 24 is formed of a roll-formed channel 260. Channel 260 has a back 262 and a pair of channel legs 264 and 266, attached to back 262 at smoothly radiused roll formed corners of channel 260. Legs 264 and 266 each have a proximal portion 268 or 270 joined at a smoothly radiused corner to back 262. Proximal portions 268 and 270 are mutually parallel and extend away from back 262 more or less at right angles, and terminate at an inwardly extending step 272, 274. Step 272 (or 274) ends at a distal portion 276 or 278 of leg 264, or 266, these distal portions again extending mutually parallel to each other and each terminating in a doubled over, or folded back toe 280 or 282 to provide extra strength near carriage 34. The gap 'G' between toes 280 and 282 defines a longitudinal opening in channel 260 through which the outwardly extending portion of carriage 34, or 32 can protrude for connection to the load bearing arms 36 and 38.

Back 262 has a pair of shoulders 284 and 286 and a generally central, outwardly extending stepped dorsal rebate in the nature of a blister, ridge, or protrusion 288, the clearance gap left between the wall of the rebate and the rack provides more room to accommodate the rack of dorsal channel 244. Protrusion 288 is roll formed and has a smoothly radiused chamfer at each shoulder 284 and 286.

A spring loaded safety dog assembly 290 is mounted to the exterior of protrusion 288, at a safety stop mount site on upright 32, or 34, with safety dog 248 extending therethrough to engage notches 246. A safety dog release 292 is linked by a spring loaded cable 294 to the safety dog assembly 290 on upright 22 or 24 to permit an operator on one side to release both dogs at one time while operating flow control valve 100. Upward travel of carriages 32 and 34 is limited by upper carriage stops 296 mounted within the upper ends of uprights 22 and 24 to intercept upper guide bearings 256.

The respective sets of shoulder 284, or 286, proximal portion 268 or 270 and step 272 or 274 define a guide in the nature of a three sided slot, channel, or groove in which bearings 256 and 258 can ride in a gentle interference fit in the manner of guide followers. In the embodiment shown, channel 260 has a longitudinal axis 300 defining the direction of relative motion to which carriage 32 or 34 is restricted by the guide and guide follower combination. Channel 260 also has a vertical plane of symmetry 302 mid-way between legs 264 and 266.

Although channel 260 is symmetrical, which simplifies manufacturing, an asymmetrical channel could be used, in which only one of the channel legs is formed to guide the carriage, whether with a stepped leg, a re-entrant curled over, or inward lip, an arcuate sidewall, or some other form that restricts the motion of the lifting carriage to the longitudinal direction. In a design in which both channel legs are formed to guide the carriage, the guides need not be identical and need not be directly opposed, but could be offset. Further, although a roll formed channel is preferred, a separate insert, or rail could be located within channel 260 to act as a guide. Again, while it is preferred that the corners of the profile of channel 260 be roughly at right angles, a suitable guide could be formed with a tapered step at some shallower angle, or with a curved section. Channel 260 can be made to act as a retainer when the breadth of channel 260 between some point between back 262 and toes 280 and 282 is greater that the width of the gap between toes 280 and 282.

The bearing surface of the guide follower could be a roller or ball bearing, but a sliding polymer is preferred for its simplicity. Further, the bearing surface need not bear directly upon the inner surface of channel 260. The shape of the profile of channel 260 would continue to define the guide, and it would not depart from the spirit of the invention, if the inner faces of channel 260 were lined with a wear surface, or surfaces, against which the bearing of the follower could ride. Although the illustrated embodiment is preferred, the lifting apparatus could be arranged with the follower on the upright and the bearing surface on the lifting carriage, rather than the other way around.

Similarly, although it is preferred that the rebate indicated as protrusion 288 be located centrally with respect to back 262 of channel 260, and the spine of the first portion of lifting carriage 32 or 34, it need be. For example, it could be placed to act on a rack facing sideways (that is, the rack lying in a plane parallel to the plane of symmetry, rather than perpendicular to it). Further, while a safety dog is used, a suitable safety stop alternative in the nature of gearing, or a pawl, a tooth, or other projection or group of projections for engaging the catches of the rack could be used.

Although a particular preferred embodiment of the invention, and a number of alternative embodiments have been described herein and illustrated in the figures, the principles of the present invention are not limited to those specific embodiments. The present invention is defined by the claims which follow and equivalents thereto.

What is claimed is:

1. An upright for use in cooperation with a mating moveable lifting carriage of a lifting apparatus, the carriage having a rack, wherein said upright comprises:

a wall member having a back and a pair of opposed legs extending therefrom to define a channel therewithin, said channel extending in a direction defined as a longitudinal direction, and said channel being capable of receiving a portion of the lifting carriage therein, said wall member having an opening defined therein between said legs, said opening permitting another portion of the lifting carriage to protrude therethrough;

at least on guide for restricting the lifting carriage to motion along said channel;

a rebate formed in said back of said wall member to accommodate motion of said rack, said rebate giving a clearance gap between said rebate and the rack when the lifting carriage is moveable engaged within said channel; and an aperture through said upright to permit a safety stop mounted externally to said upright to extend inwardly therethrough to engage the rack.

2. The combination of an upright and a mating moveable lifting carriage, both for use in a lifting apparatus, wherein:

said upright has a wall member having a back and a pair of opposed legs extending therefrom to define a channel therewithin, said channel extending in a direction defined as a longitudinal direction, said wall member having an opening extending therealong to give access to said channel;

said wall member having at least one guide for restricting the lifting carriage to longitudinal motion relative to said upright;

said wall member having a longitudinal rebate formed in said back, said rebate giving a clearance gap between said rebate and the rack when said lifting carriage is engaged within said channel;

said lifting carriage has a first portion engaged within said channel, said first portion being moveable along said channel;

a second portion attached to said fist portion, said second portion extending through said opening of said channel;

a rack on said first portion said rack being positioned to face, and to be accommodated by, said rebate; and at least one guide follower for engaging said at least one guide;

said first portion having a spine aligned relative to said channel; and said rack being formed from a channel member, said channel member having toe mounted to said spine, and a channel back; said channel back having openings let therethrough for engagement by a safety stop.

* * * * *

UNITED STATES PATENT AND TRADEMARK OFFICE

CERTIFICATE OF CORRECTION

PATENT NO. : 6,279,685 B1
DATED : August 28, 2001
INVENTOR(S) : Eduard Kogan et al.

It is certified that error appears in the above-identified patent and that said Letters Patent is hereby corrected as shown below:

Column 10, claim 1,
Line 22, change "on" to -- one --.
Line 28, change "moveable" to -- moveably --.

Column 10, claim 2,
Line 52, change "fist" to -- first --.
Line 62, change "toe" to -- toes --.

Signed and Sealed this

Twenty-sixth Day of February, 2002

*Attest:*

*Attesting Officer*

JAMES E. ROGAN
*Director of the United States Patent and Trademark Office*